US006609693B2

(12) United States Patent
Hui

(10) Patent No.: US 6,609,693 B2
(45) Date of Patent: Aug. 26, 2003

(54) HANGER COMBINATION FOR DISPLAYING MERCHANDISE

(76) Inventor: Sau Fong Hui, 5300 E. Concours St., Ontario, CA (US) 91764

( * ) Notice: Subject to any disclaimer, the term of this patent is extended or adjusted under 35 U.S.C. 154(b) by 0 days.

(21) Appl. No.: 10/075,855

(22) Filed: Feb. 11, 2002

(65) Prior Publication Data

US 2003/0106980 A1 Jun. 12, 2003

Related U.S. Application Data

(63) Continuation-in-part of application No. 10/011,223, filed on Dec. 6, 2001, now abandoned.

(51) Int. Cl.[7] ..... A47G 1/16

(52) U.S. Cl. ..... 248/489; 248/304; 248/307; 248/308; 248/317; 248/339

(58) Field of Search ..... 211/59.1; 248/304, 248/308, 339, 317, 323, 307, 489, 466; 40/642.01, 719, 745, 748; 53/413, 134.1, 467

(56) References Cited

U.S. PATENT DOCUMENTS 468,639 A * 2/1892 Bryant ..... 248/685
746,617 A * 12/1903 Wenzell ..... 190/102
3,179,363 A * 4/1965 Sheiman ..... 248/214
3,289,985 A * 12/1966 Sheiman ..... 223/85
3,512,621 A * 5/1970 Teetor ..... 206/287
4,542,824 A * 9/1985 Allen ..... 206/287.1
4,632,242 A * 12/1986 Choi et al. ..... 206/45.24
5,064,061 A * 11/1991 Moxley ..... 206/289
5,291,976 A * 3/1994 Ku ..... 16/113.1
5,593,009 A * 1/1997 King ..... 190/102
5,927,451 A * 7/1999 Tsai ..... 16/405
RE36,412 E * 11/1999 Jones ..... 206/223
6,102,461 A * 8/2000 Rooney et al. ..... 248/497

* cited by examiner

*Primary Examiner*—Leslie A. Braun
*Assistant Examiner*—Ingrid Weinhold
(74) *Attorney, Agent, or Firm*—Sheldon & Mak; Denton L. Anderson

(57) ABSTRACT

A hanger combination useful for the display of merchandise items has a base plate and a hanger rail. The hanger rail is attached to the base plate such that the hanger rail can be alternatively moved between a retracted hanger rail position wherein the hanger rail is proximal to the base plate and an extended hanger rail position wherein the hanger rail is spaced apart from the base plate.

15 Claims, 1 Drawing Sheet

HANGER COMBINATION FOR DISPLAYING MERCHANDISE

RELATED APPLICATIONS

This application is a continuation-in-part of U.S. patent application Ser. No. 10/011,223, filed Dec. 6, 2001 and entitled Hanger Combination for Displaying Merchandise, now abandoned.

FIELD OF THE INVENTION

This invention relates generally to hanger combinations and, more specifically, to hanger combinations suitable for displaying merchandise.

BACKGROUND OF THE INVENTION

The mass marketing of small merchandise items requires efficient systems for displaying the merchandise items at retail establishments. One very popular system for displaying merchandise items is to hang the merchandise items on horizontal display rods as illustrated in FIG. 1 of this application. To accomplish this, the distributor of the merchandise items frequently attaches a display hanger mechanism to each item of merchandise so that each item of merchandise can be immediately affixed to horizontal display rods at resale establishments. In the prior art, such display hanger mechanisms are one-piece units as illustrated in FIG. 1.

The problem with the use of such one-piece display hanger mechanisms is that they project outwardly beyond the perimeter of the merchandise item to which they are attached. This makes it very awkward to pack and ship the merchandise items and adds considerably to the expense of packing and shipping the merchandise items.

Accordingly, there is a need for an improved device for hanging merchandise at a retail establishment which avoids these problems in the prior art.

SUMMARY

The invention satisfies this need. The invention is a hanger combination suitable for displaying merchandise items. The hanger combination comprises (a) a base plate for fastening to the back of an item of merchandise, and (b) a hanger rail slidably attached to the base plate such that the hanger rail can be alternatively moved between a first hanger rail position wherein the hanger rail is proximal to the base plate and a second hanger rail position wherein the hanger rail is spaced apart from the base plate by a distance of at least about ½ inch.

DRAWINGS

These features, aspects and advantages of the present invention will become better understood with regard to the following description, appended claims and accompanying figures where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 4:
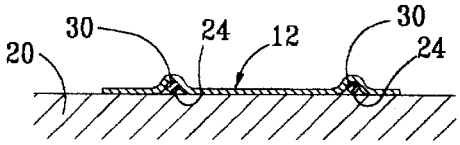
FIG. 4 is a cross-sectional side view of the hanger rail combination illustrated in FIG. 2, taken along line 4—4.
Figure 2:
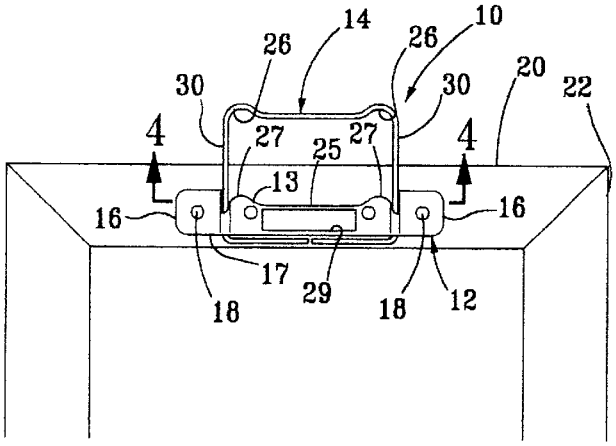
FIG. 2 is a plan view of a hanger combination having features of the invention, the hanger rail combination having a hanger rail which is shown in a retracted hanger rail position.
Figure 3:
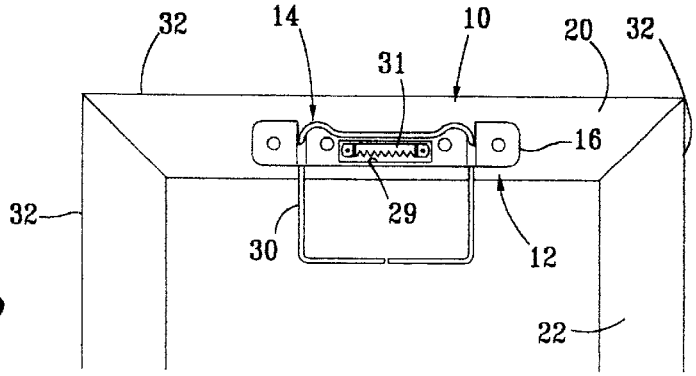
FIG. 3 is a second plan view of the hanger combination illustrated in FIG. 2, the hanger rail being shown in an extended hanger rail position.

The invention is a hanger combination 10 comprising a base plate 12 and a hanger rail 14. The hanger combination 10 is illustrated in FIGS. 2–4. In the embodiment illustrated in these drawings, the base plate 12 is an elongate strip having an upper edge 13, a lower edge 17 and a pair of opposed ends 16. The base plate 12 typically has a hole 18 at each of the opposed ends 16 to allow for a nail, screw or other fastening means to be disposed through each hole 18 to facilitate the attachment of the base plate 12 to an item of merchandise 20, such as to a picture frame 22, as illustrated in the drawings.

In the embodiment illustrated in the drawings, the base plate 12 further comprises a pair of base plate indentations 24, the purpose of which will be explained below.

The base plate 12 can be made from a lightweight metal. Other materials, such as suitable plastic materials, can also be used.

The base plate 12 preferably is sculpted across its upper edge 13 between the pair of base plate indentations 24 as illustrated in FIG. 2. Such sculpting of the upper edge 13 provides a base plate central horizontal depression 25 sandwiched on opposite sides by a pair of base plate raised portions 27. The purpose of such sculpting is discussed below.

The base plate 12 preferably also defines a central elongate aperture 29. In FIG. 2, the central elongate aperture 29 is shown as having a rectangular shape. Other elongate shapes can also be used. Typically, the length of the central elongate aperture 29 is between about ½ inch and about 1½ inches. The central elongate aperture 29 provides an open area wherein the end user can install a picture frame hanger bar 31 as illustrated in FIG. 3.

Figure 1:
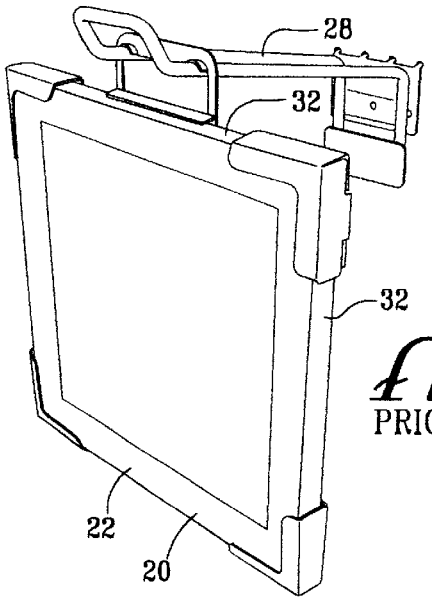
FIG. 1 PRIOR ART
FIG. 1 is an isometric view of an item of merchandise hung from display hanger rails using a display hanger mechanism of the prior art.

The hanger rail 14 is typically generally linear as illustrated in the drawings. In the embodiment illustrated in the drawings, the hanger rail 14 has a pair of spaced apart connection member indentations 26 suitable for retaining the hanger rail 14 on a pair of generally horizontal display rods 28 as illustrated in FIG. 1. In embodiments having a pair of base plate raised portions 27, each connection member indentations 26 is adapted to nest within one of the base plate raised portions 27.

The hanger rail 14 is attached to the base plate 12 such that the hanger rail 14 can be alternatively moved between a retracted hanger rail position wherein the hanger rail 14 is proximal to the base plate 12 and an extended hanger rail position wherein the hanger rail 14 is spaced apart from the base plate 12 by a distance of at least about ½ inch. In the embodiment illustrated in the drawings, this is achieved by providing a pair of opposed base plate attachment members 30, each of the base plate attachment members 30 being connected to one of the two ends of the hanger rail 14. The two base plate attachment members 30 are each slidably disposed within one of the two base plate indentations 24 as illustrated in the drawings.

In one typical embodiment, the hanger rail 14 and the base plate attachment members 30 are made from a single continuous length of lightweight metal having a generally circular cross-section. However, many other materials, forms and shapes can also be used in the invention.

Typically, the hanger rail 14 in the extended hanger rail position is spaced apart from the base plate 12 by a distance of at least about 1 inch and, in some embodiments, by a distance of at least 1¼ inches.

In a typical embodiment, the length of the hanger rail 14 is between about 3 inches and about 3½ inches, but hanger combinations 10 of larger and smaller sizes can also be constructed using the same basic concept of the invention as illustrated herein. Similarly, it is typical that the distance between the pair of spaced apart connection member indentations 24 be between about 1½ inches and about 2 inches, but wider or narrower dimensions can also be used.

In operation, the hanger combination 10 is conveniently used to ship and display a plurality of similarly sized merchandise items 20 by the steps described as follows. First, a hanger combination 10 as described above is attached to each item of merchandise 20. In the embodiment illustrated in the drawings, the item of merchandise 20 comprises a picture frame 22 and may be an item of mass-produced artwork disposed within a picture frame 22.

Each hanger combination 10 is attached to an item of merchandise 20, such that, when the hanger rail 14 is in the retracted hanger rail position, the hanger rail 14 is disposed within the perimeter 32 of the item of merchandise 20.

After a hanger combination 10 is attached to each of the items of merchandise 20, each of the hanger rails 14 is moved to the retracted hanger rail position, thereby positioning each of the hanger rails 14 within the perimeter 32 of its item of merchandise 20. When this is done, the plurality of merchandise items 20 can be disposed within a single container with minimum effort (since no portion of the hanger combination 10 protrudes outside of the perimeter 32 of any single item of merchandise 20).

After the merchandise 20 is packed within a single container, the merchandise 20 is shipped to a retail establishment. At the retail establishment, at least one of the merchandise items 20 can be removed from the container and displayed at the retail establishment. This is conveniently done by moving the hanger rail 14 on a merchandise item 20 to be displayed to the extended hanger rail position and hanging the merchandise 20 over generally horizontal rods 28 projecting from a surface within the retail establishment. In a typical embodiment, the horizontal rods 28 nest within corresponding connection member indentations 26 in the hanger rail 14.

Where the hanger combination 10 is of the embodiment illustrated in the drawings, the end user can easily and conveniently hang the item of merchandise 20 on a vertical surface without removing the hanger combination 10. The end user first lowers the hanger rail 14 into abutment with the upper edge 13 of the base plate 12 until the connection member indentations 26 nest within the pair of base plate raised portions 27. This fully reduces the height of the hanger rail 14 to well within the outside perimeter 32 of the merchandise item 20. Next, the end user installs a picture frame hanger bar 31 within the central elongate aperture 29 within the base plate 12. After this is accomplished, the end user conveniently hangs the merchandise item 20 on a projection disposed from a desired vertical surface, using the picture frame hanger bar 31.

Thus, the use of the invention markedly decreases the difficulty and expense of shipping multiple items of merchandise ready for immediate display at a retail establishment.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A hanger combination suitable for displaying merchandise, the hanger combination comprising:

(a) a base plate for fastening to the back of an item of merchandise; and (b) a generally linear hanger rail slidably attached to the base plate such that the hanger rail can be alternatively moved between a retracted hanger rail position wherein the hanger rail is proximal to the base plate and an extended hanger rail position wherein the hanger rail is spaced apart from the base plate by a distance of between ½ inch and 1¼ inch wherein the hanger rail has at least one connection member indentation.

2. The hanger combination of claim 1 wherein the base plate has one or more holes therethrough for fastening the base plate to the back of an item of merchandise.

3. The hanger combination of claim 1 wherein the base plate comprises an elongate strip having a pair of opposed ends and wherein a hole is disposed through the elongate strip at each of the opposed ends.

4. The hanger combination of claim 1 wherein the length of the hanger rail is between about 3 inches and about 3½ inches.

5. The hanger combination of claim 1 wherein the hanger rail has a pair of spaced apart connection member indentations.

6. The hanger combination of claim 5 wherein the pair of spaced apart connection member indentations are spaced apart by a distance between about 1½ inches and about 2 inches.

7. The hanger combination of claim 1 wherein the hanger rail is attached to the base plate by a pair of opposed base plate attachment members, each of the base plate attachment members being slidably attached to the base plate.

8. The hanger combination of claim 7 wherein the base plate comprises a pair of base plate indentations, each base plate indentation slidably retaining one of the base plate attachment members.

9. The hanger combination of claim 1 wherein the hanger combination is attached to the back of an item of merchandise.

10. The hanger combination of claim 9 wherein the item of merchandise comprises a hanger frame.

11. The hanger combination of claim 5 wherein the base plate has an upper edge and a lower edge, and wherein the upper edge is sculpted to have a base plate horizontal depression sandwiched between a pair of base plate raised portions, each base plate raised portion being adapted to nest within one of the connection member indentations.

12. The hanger combination of claim 1 wherein the base plate defines a central elongate aperture.

13. A hanger combination suitable for displaying merchandise, the hanger combination comprising:

(a) a base plate for fastening to the back of an item of merchandise, the base plate having an upper edge and a lower edge, the upper edge being sculpted to have a base plate horizontal depression sandwiched between a pair of base plate raised portions; and (b) a hanger rail slidably attached to the base plate such that the hanger rail can be alternatively moved between a retracted hanger rail position wherein the hanger rail is proximal to the base plate and an extended hanger rail position wherein the hanger rail is spaced apart from the base plate by a distance of at least ½ inch, the hanger rail having a pair of spaced apart connection member indentations;

wherein each base plate raised portion is adapted to nest within one of the connection member indentations.

14. A hanger combination suitable for displaying merchandise, the hanger combination comprising:

(a) a base plate for fastening to the back of an item of merchandise, the base plate defining a central elongate aperture; and (b) a hanger rail slidably attached to the base plate such that the hanger rail can be alternatively moved between a retracted hanger rail position wherein the hanger rail is proximal to the base plate and an extended hanger rail position wherein the hanger rail is spaced apart from the base plate by a distance of at least ½ inch.

15. A merchandise combination comprising:

(a) a picture frame; and (b) a hanger combination attached to the back of the picture frame, the hanger combination comprising:

(i) a base plate for fastening to the back of an item of merchandise; and (ii) a hanger rail slidably attached to the base plate such that the hanger rail can be alternatively moved between a retracted hanger rail position wherein the hanger rail is proximal to the base plate and an extended hanger rail position wherein the hanger rail is spaced apart from the base plate by a distance of at least about ½ inch.

* * * * *